United States Patent [19]

Wied

[11] 4,256,942

[45] Mar. 17, 1981

[54] TRIGGER OPERATED TOOL HANDLE SWITCH

[75] Inventor: Julius P. Wied, Hudson, Ohio

[73] Assignee: Lucerne Products, Inc., Hudson, Ohio

[21] Appl. No.: 963,778

[22] Filed: Nov. 27, 1978

[51] Int. Cl.[2] ..... H01H 1/44; H01H 13/52

[52] U.S. Cl. ..... 200/157; 200/164 R; 200/260

[58] Field of Search ..... 200/16 R, 16 C, 157, 200/164 R, 253, 260

[56] References Cited

U.S. PATENT DOCUMENTS

| | | | |
|---|---|---|---|
| 2,521,468 | 9/1950 | Lodge | 200/16 C |
| 2,966,560 | 12/1960 | Gluck | 200/16 C |
| 3,222,488 | 12/1965 | Matthews | 200/157 X |
| 3,594,523 | 7/1971 | Frenzel | 200/16 C X |
| 3,629,534 | 12/1971 | Reviel | 200/157 |
| 3,739,126 | 6/1973 | Sahrbacker et al. | 210/157 |
| 3,971,906 | 7/1976 | Sahrbacker | 200/157 |

FOREIGN PATENT DOCUMENTS

| | | | |
|---|---|---|---|
| 1229167 | 11/1966 | Fed. Rep. of Germany | 200/16 C |
| 2310716 | 9/1974 | Fed. Rep. of Germany | 200/16 C |

*Primary Examiner*—Stephen Marcus

*Attorney, Agent, or Firm*—Baldwin, Egan, Walling & Fetzer

[57] ABSTRACT

An electrical switch having spaced stationary contacts and a contact carrier carrying a bridging contact in linear reciprocation relative to the stationary contacts, with the bridging contact biased toward the stationary contacts. The bridging contact has spaced opposite contacting ends forming a leading contact end and a trailing contact end for sliding movement between a bridging position where the contacting ends contact their respective stationary contacts, and a non-bridging position where the leading contact end is out of engagement with its stationary contact. The bridging contact is rotatably hinged to the contact carrier and a projection is disposed between the stationary contacts for engagement with the leading contact end for pivoting and lifting the leading contact end from its stationary contact in coaction with the hinged connection with a quick break action during movement of the contact carrier to the non-bridging position.

Each conductor wire connected to the switch is releasably secured therein by a spring-like retainer blade biased diagonally against the wire. Each retainer blade has a release arm for deactivating the retainer blade thus permitting easy withdrawal of the conductor wire. The release arm has a laterally extending handle lug on its exteriorly exposed free end to provide a handle and also to provide for engagement with the switch housing to limit inward movement of the release arm. The inner end of the release arm is beveled to provide a plane-to-plane contact with the retainer blade for a positive contact therewith.

4 Claims, 10 Drawing Figures

TRIGGER OPERATED TOOL HANDLE SWITCH

BACKGROUND OF THE INVENTION

The present invention has to do with improvements in trigger operated electric switches of the type wherein a bridging contact is slid between bridging and non-bridging positions with respect to a pair of fixed contacts mounted in spaced relation on a dielectric base. The bridging contact includes a pair of spaced contact faces arranged for simultaneous engagement with respective fixed contacts thereby to define the bridging position of the bridging contact. One of these contact faces may slide along the associated fixed contact and remain in engagement with the same at all times. When the other of these contact faces engages the other fixed contact, the switch is closed for closing the associated circuit and energizing a load device, such as an electric motor. It is desirable that this other contact face be maintained in substantial spaced relation from the other fixed contact to define the open or "off" position of the switch. When it is desired to close the switch and circuit, it is desirable that such other contact face be brought into engagement with the other fixed contact in a quick and positive manner. This same quick and positive action is also desirable upon opening of the switch, such "quick break" action being essential to forestall premature pitting and corrosion of the contact surfaces.

Also, in such prior switches, plug in-type terminals are used for rapidly coupling the apparatus to electrical conductor lines. With this plug in-type terminal, it is extremely difficult to remove the conductor wire. When it is desired to do so, it usually necessitates the insertion of a pointed instrument or the like, to attempt to effect release of the spring retainer blade from the conductor line. This aforesaid known operation of attempting to release the conductor line is time consuming and exasperating, and sometimes almost impossible.

SUMMARY OF THE INVENTION

Accordingly, an object of the invention is to provide a trigger operated hand tool switch effecting positive, quickbreak action upon opening of the switch.

A further object of the present invention is the provision of an electric switch including a bridging contact movable with respect to a pair of fixed contacts, wherein one end of the bridging contact is moved into and out of engagement with one of the fixed contacts in a fast and highly effective manner.

Another object of the present invention is the provision of a switch of the type described wherein the bridging contact includes a pair of spaced contact faces coacting with stationary contacts and wherein hinge means in coaction with abutment means between the stationary contacts are provided for rocking such bridging contact about one of its contact faces thereby to quickly move the other contact face into and out of quick break engagement with the associated fixed contact.

A further object of the invention is to provide a novel releasing mechanism for use with plug in-type terminals, to permit rapid manual release of the conductor lines.

Another object of the invention is to provide a novel release mechanism of the latter type which is particularly adapted for use in conjunction with compact electrical control switches which are used for controlling an electric motor, as for instance, in portable electrical tools, appliances or the like.

A still further object of the invention is to provide a mechanism for the aforesaid type which can be used with existing compact switch structures, for controlling an electric motor, and as for instance, controlling the speed of an electric motor, and wherein the release mechanism is adapted to be quickly actuated to operative position merely by pressing on the release mechanism so as to cause release of the conventional spring retainer from coaction with a conductor wire.

A still further object of the invention is to provide a release mechanism for use with a compact electrical control switch for controlling the operation of electrical motor, used for instance in a portable electric tool, appliance or the like and wherein the release mechanism is adapted for complementary coaction with the existing structure of the control switch.

A further object of the invention is to provide a trigger operated switch of the above type that is simple in construction, inexpensive to manufacture, and highly effective in operation.

Briefly, the foregoing objects are accomplished by the provision of an electric switch mechanism for portable electric motor-drive type tools including an insulator switch housing with at least a pair of stationary electrical contacts disposed in the switch housing in spaced relation to each other and with their contact making faces substantially coplanar. A reciprocable contact carrier is disposed in the housing for linear reciprocation therein relative to said stationary contacts. A movable electrically conductive bridging contact is carried by the contact carrier and has opposite contacting ends forming respectively a leading contact end and a trailing contact end spaced at approximately the same spacing as the stationary contacts for sliding movement between a non-bridging position where the bridging contact is out of engagement with at least one of said stationary contacts and a bridging position where the bridging contact is in engagement with at least two of the stationary contacts in electrically conducting relation therewith. The bridging contact has an aperture disposed at its trailing contact end, and the contact carrier has a protuberance extending transversely into the plane of the contact carrier and through the aperture to hingedly secure the bridging contact to the contact carrier to provide hinge means rotatably securing the bridging contact at a point adjacent its trailing contact end to the contact carrier. Bias means is provided in the contact carrier in the form of a compressed coil spring urging the movable bridging contact towards the stationary contacts. A projection is disposed between the stationary contacts for engagement with the leading contact end and is configured for pivoting and lifting the leading contact end off of the adjacent respective stationary contact with a quick break action during reciprocable movement of the contact carrier to a level substantially above the contact making face of the adjacent respective stationary contact. The bridging contact aperture is elongated permitting added linear and pivotal movement to the bridging contact to position the leading contact end at a level substantially above the contact making face of the adjacent respective stationary contact.

In one form of the invention, the projection between the spaced stationary contacts is approximately one-eighth of an inch in height to provide sufficient arcbreaking distance for the voltages encountered in hand tool use.

As will be shown herein, there is provided an electrical switch mechanism for a portable electric motor driven type tool including a trigger switch assembly having a switch housing and a switch module portion disposed within the switch housing. The module portion includes a module casing, a plurality of spaced stationary electrical contacts disposed in the casing, a spring-like elongated retainer blade coacting with each contact and diagonally disposed with respect to the contact with the free end of the blade adapted when in active condition to releasably engage an associated insertable bared conductor wire for gripping the latter to hold it in place against the contact. The module casing has a wire passageway disposed below and leading to a point near the free end of the retainer blade and adjacent the contact for receiving the bared conductor wire. The module casing also has a release arm passageway adjacent the wire passageway with a wire release arm disposed in the release arm passageway for selectively deactivating the retainer blade to permit ready withdrawal of the wire from coaction with the respective stationary contact. The release arm passageways are formed in part by the switch housing. The release arm is slidable in the release arm passageway so as to be engageable with the retainer blade for moving the latter out of gripping coaction with the wire to permit withdrawal of the wire from the module. The lower portion of the release arm is disposed exteriorly of the module casing exterior. The module casing has a shoulder extending toward the release arm, and the release arm has an arm abutment engaging the shoulder to retain the release arm in the release arm passageway to provide locking means on the release arm for retaining the release arm in assembled relation within the module casing. The release arm has a laterally extending handle lug on its exteriorly exposed free end for engagement with the exterior surface of the module casing to limit inward movement of the release arm with respect to the module casing and also forms a handle enabling facile manual operation of the release arm. The inner end of the release arm which contacts the retainer blade is beveled to effect a plane-to-plane contact with the retainer blade to provide a more positive and firm contact therewith. Each contact has a retainer blade with a coacting release arm, such structure further including adjacent release arms being connected together to form a "U"-shaped tandem release member.

Other objects and advantages of the invention will be apparent from the following description taken in conjunction with the accompanying drawings wherein:

DESCRIPTION OF THE PREFERRED EMBODIMENTS

Figure 1:
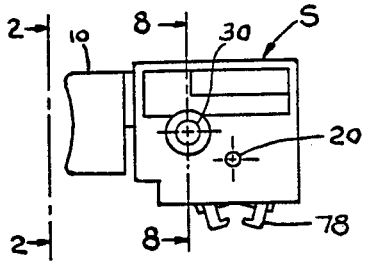
FIG. 1 is a front elevational view of a trigger operated switch embodying the present invention.

In the drawings, like numbers and/or letters refer to like parts.

Figure 2:
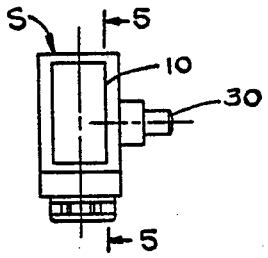
FIG. 2 is a side elevational view taken along the line 2—2 of the switch shown in FIG. 1.
Figure 3:
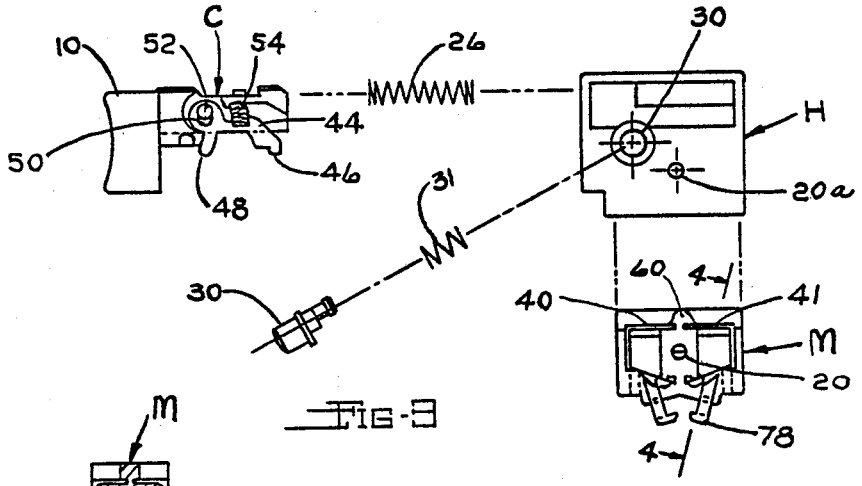
FIG. 3 is an exploded view of the switch shown in FIG. 1, and showing the major components thereof in position prior to assembly.

Referring first to FIGS. 1–3, there is shown an electric switch mechanism for portable electric hand tools, generally designated as S, which includes as basic components the wrap-around switch housing H (FIG. 3) which encases the switch module or casing M that is operated by the bridging contact carrier C having a trigger handle 10.

Casing M may be readily formed from electrical insulating material such as plastic or the like, and has nibs 20 on the sides thereof which are adapted to be received in snap-fastening relation in openings **20*a*** in the confronting sides of the housing member H for detachably holding the casing M and associated components in assembled relation with the wrap-around housing H.

The contact carrier C is reciprocably retained in the housing H by the interlocking action of the contact carrier tab 22 (FIG. 5), engaging the switch housing rib 24 in coaction with the compressed coil contact carrier spring 26, which biases the contact carrier to a leftward "off" position as shown.

Figure 5:
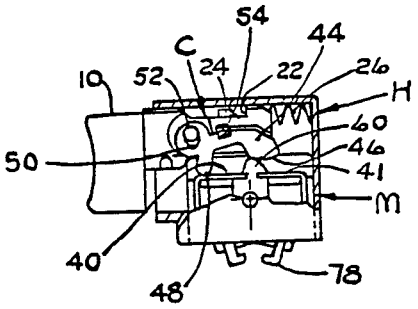
FIG. 5 is a partial front elevation and a partial section taken along the line 5—5 of FIG. 2, and showing the switch in "off" position.

A suitable spring push button plunger 30 is provided to coact with the trigger 10 and lock the contact carrier C in its full "on" position as is well known in the art. The plunger 30 is adapted to be pushed inwardly against the bias of its compressed coiled spring 31 to a releasably locked position as shown in FIG. 8, such that the plunger pin 32 is disposed in the contact carrier notch 33 when it is desired to hold the contact carrier C in its full "on" or switch closing position. In operation, the trigger 10 is pressed inwardly such that the contact carrier C is moved to the position shown in FIG. 7, then the plunger 30 is pressed inwardly and the trigger 10 is released, whereupon the contact carrier spring 26, which normally urges the contact carrier C to switch-open position, presses the contact carrier C against the spring-pressed plunger 30 and holds it in depressed position. The next pressure upon the trigger 10 releases the spring-pressed plunger 30 so that it jumps outwardly and releases the contact carrier C to its "off" position as shown in FIG. 5. The spring pressed plunger mechanism 30 will not be described in more detail as the same forms no part of the present invention and is fully described in assignee's U.S. Pat. No. 3,536,973, issued Oct. 27, 1970.

The present invention is directed to improvements in electric switches of the type shown in the switch mechanism portion of assignee's U.S. Pat. No. 3,603,757, issued Sept. 7, 1971, U.S. Pat. No. RE. 26,267 issued on Sept. 26, 1967 and its parent U.S. Pat. No. 3,222,488 issued on Dec. 7, 1965, such present invention now being described in an embodiment of a switch which makes and breaks the contacts in both sides of an energizing electrical source, although those skilled in this art will understand that one side only of the line might incorporate the switch while the other line was unbroken.

Figure 6:
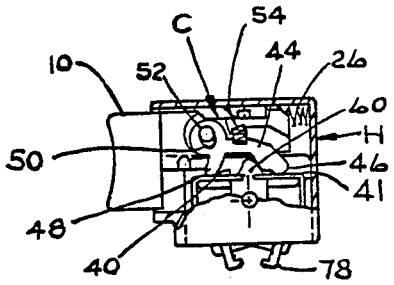
FIG. 6 is a view similar to FIG. 5 and showing the bridging contact at its final point of descent from the contact abutment and at its initial point of contact with the adjacent stationary contact.
Figure 7:
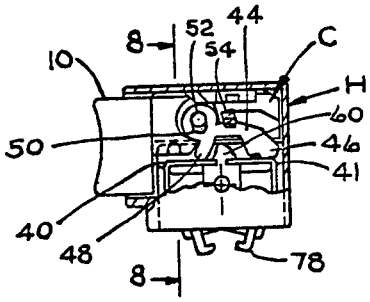
FIG. 7 is a view similar to FIG. 6, but showing the switch in final "on" position.
Figure 8:
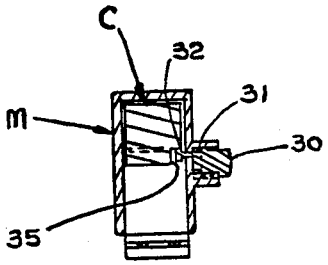
FIG. 8 is a view taken along the line 8—8 of FIG. 7.

Referring now to FIGS. 5–7, the insulator switch housing H contains the switch module portion M which has at least a pair of spaced stationary electrical contacts 40 and 41 having their contact making faces coplanar. The contact carrier C is disposed in the housing H for linear reciprocation relative to the stationary contacts as described in the aforementioned U.S. Pat. No. 3,603,757. The contact carrier is normally disposed in a leftward "off" position, as shown in FIG. 5, by the biasing action of the compressed contact carrier coil spring 26 which is disposed between the contact carrier and the opposite wall of the housing H.

The contact carrier C carries with it in its reciprocable movement a electrically conductive bridging contact 44 which has opposite coacting ends forming, respectively, a leading contact end 46, and a trailing contact end 48, spaced approximately at the same spacing as the stationary contacts 40 and 41, for sliding movement between a non-bridging position (FIG. 5), where the bridging contact leading end 46 is out of engagement with the stationary contact 41 and a bridging position (FIGS. 6 and 7), where the bridging contact leading edge 46 is in engagement with the stationary contact 41 in electrically conducting relation therewith. The trailing end 48 is always in contact with the stationary contact 40.

The bridging contact 44 is hinged to the contact carrier C by suitable hinge means preferably in the form of the bridging contact aperture 50 disposed at the trailing contact end of the bridging contact in coaction with the contact carrier protuberance 52 extending transversely from the contact carrier into and through the aperture 50 to hingedly secure the bridging contact 44 to the contact carrier C. It is to be noted that the aperture 50 is elongated permitting added linear and pivotal movement to the bridging contact 44 to position the leading contact end 46 at a level substantially above the contact making face of the adjacent respective stationary contact 41 in the "off" position.

The bridging contact is biased towards the stationary contacts 40 and 41 by suitable bias means in the form of the compressed coil spring 54 disposed between the bridging contact 44 and the contact carrier C as shown.

A projection 60 is disposed between the stationary contacts 40 and 41 for engagement with the contact carrier leading contact end 46, and is configured for pivoting and lifting the leading contact end off of the adjacent respective stationary contact 41 (in coaction with the aforedescribed hinge means 50, 52), with a "quick break" action during movement of the bridging contact leading contact end 46 to a level substantially above the contact making face of the adjacent respective stationary contact 41.

In one form of the invention, the projection 60 is approximately one-eighth of an inch in height above the plane of the contact making faces of the stationary contacts 40 and 41 to provide, in coaction with the aforedescribed "quick break" action, a quick and positive clean-break of any electrical arc that may develop between the leading end 46 and the stationary contact 41 from the voltages (110 or 220 volts) normally encountered in electric hand tool use.

Figure 9:
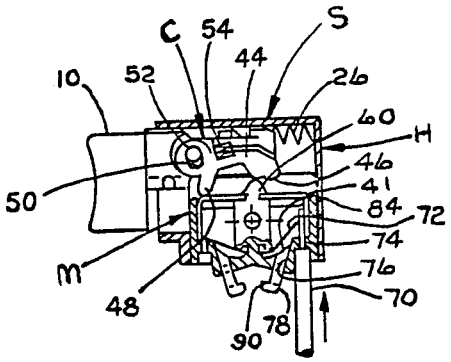
FIG. 9 is a front elevational sectional view of the switch shown in FIG. 1, and showing a conductor wire inserted in operational position therein.
Figure 10:
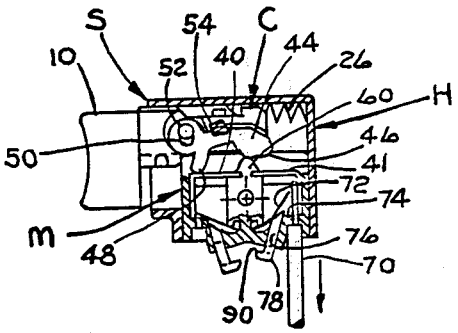
FIG. 10 is a view similar to FIG. 9, but showing a wire release arm deactivating its wire retainer blade.

Referring now to the construction shown in FIGS. 9 and 10, each conductor wire such as, for example, the wire 70, leading in and connected to the switch S is secured therein by a spring-like elongated diagonally disposed retainer blade 72 biased against the wire 70 to provide firm electrical contact between the wire and the stationary blade 41, and to provide firm retention of the wire in such position in the switch. The present modification is an improvement over the structure shown in assignee's U.S. Pat. No. 3,977,751, issued Aug. 31, 1976.

The module casing M has a wire passageway 74 disposed below and leading to a point near the free outer end of the retainer blade 72 and adjacent the stationary contact 41 for receiving the bared portion of the conductor wire 70. The module casing M also has a release arm passageway 76 adjacent the wire passageway 74 and a wire release arm 78 is disposed in the release arm passageway 76 for selectively deactivating the retainer blade 72 by upward movement of the release arm to permit ready withdrawal of the wire 70 from coaction with the respective stationary contact 41. The release arm 78 is thus slidable in the release arm passageway 76 so as to be engageable with the retainer blade 72 for moving the latter out of gripping coaction with the wire 70 to permit withdrawal of the wire from the module M. It will be noted that the aforedescribed passageways are formed in part by the switch housing H.

Figure 4:
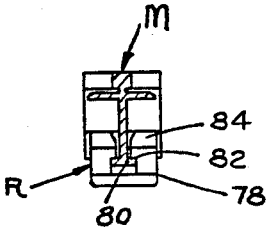
FIG. 4 is a sectional view taken along the line 4—4 of FIG. 3.

A retaining means is provided to retain the release arm 78 in operating position with the module M. Specifically, the release arm 78 has locking means in the form of an arm abutment 80 (FIG. 4). Likewise, the module casing has restraining means in the form of a shoulder 82 extending toward the release arm 78 to engage the arm abutment 80 and reciprocably retain the release arm in operative position in the release arm passageway 76.

It is to be noted that the inner end 84 of the release arm 78, which contacts the retainer blade 72, is beveled to effect a plane-to-plane contact with the retainer blade to provide a more positive and firm contact therewith.

The lower portion of the release arm 78 is disposed exteriorly of module casing M and the release arm has a laterally extending handle lug 90 on its exteriorly exposed free end for engagement with the exterior surface of the module casing M to limit inward movement of the release arm with respect to the module casing and also forms a handle enabling facile manual operation of the release arm.

It will be noted that each stationary contact 40, 41 has a retainer blade with a coacting release arm, such structure further including adjacent release arms being connected together to form a "U"-shaped tandem release member R, as best shown in FIG. 4.

The terms and expressions which have been employed are used as terms of description, and not of limitation, and there is no intention, in the use of such terms and expressions, of excluding any equivalents of the features shown or described, or portions thereof, but it is recognized that various modifications are possible within the scope of the invention claimed.

What is claimed is:

1. An electric switch mechanism for portable electric motor-drive type tools comprising, an insulator switch housing, at least a pair of stationary electrical contacts disposed in said switch housing in spaced relation to each other and with their contact making faces substantially coplanar, a reciprocable contact carrier disposed in the housing for linear reciprocation therein relative to said stationary contacts, a movable electrically conductive bridging contact carried by said contact carrier and having opposite contacting ends forming respectively a leading contact end and a trailing contact end spaced at approximately the same spacing as said stationary contacts for sliding movement between a non-bridging position where said bridging contact is out of engagement with at least one of said stationary contacts and a bridging position where the bridging contact is in engagement with at least two of said stationary contacts in electrically conducting relation therewith, hinge means rotatably securing said bridging contact at a point adjacent its trailing contact end to said contact carrier, bias means in the contact carrier urging the movable bridging contact towards the stationary contacts, and a projection disposed between said stationary contacts for engagement with said leading contact end and configured for pivoting and lifting the leading contact end off of the adjacent respective stationary contact with a quick break action during movement of the bridging contact leading contact end to a level substantially above the contact making face of the adjacent respective stationary contact.

2. The structure of claim 1 wherein said hinge means includes said bridging contact having an aperture disposed at its trailing contact end, and said contact carrier has a protuberance extending transversely therefrom into and through the aperture to hingedly secure the bridging contact to the contact carrier.

3. The structure of claim 2 wherein said aperture is elongated permitting added linear and pivotal movement to said bridging contact to position the leading contact end at a level substantially above the contact making face of the adjacent respective stationary contact.

4. The structure of claim 1 wherein said bias means is a compressed coil spring disposed between the bridging contact and the contact carrier.

* * * * *